United States Patent [19]

Burns

[11] Patent Number: 4,596,431

[45] Date of Patent: Jun. 24, 1986

[54] TACTILE COUPLING INDICATOR FOR AN ELECTRICAL CONNECTOR

[75] Inventor: Edgar Burns, Los Angeles, Calif.

[73] Assignee: Automation Industries, Greenwich, Conn.

[21] Appl. No.: 699,799

[22] Filed: Feb. 8, 1985

[51] Int. Cl.[4] ..... H01R 13/625

[52] U.S. Cl. ..... 339/90 R; 339/113 R; 339/DIG. 2

[58] Field of Search ..... 339/89 R, 89 C, 89 M, 339/90 R, 90 C, DIG. 2, 113 R; 285/93

[56] References Cited

U.S. PATENT DOCUMENTS

| | | | |
|---|---|---|---|
| 4,290,662 | 9/1981 | Storcel | 339/113 R |
| 4,373,770 | 2/1983 | Raux | 339/113 R |
| 4,407,529 | 10/1983 | Holman | 339/89 R |
| 4,531,801 | 7/1985 | Baur | 339/89 M |

*Primary Examiner*—John McQuade

*Attorney, Agent, or Firm*—George J. Netter

[57] ABSTRACT

An expandable ring is expanded during connector mating to extend outwardly of the external surface of a connector element which on touching reveals at a subsequent point in time that the connector is mated.

10 Claims, 4 Drawing Figures

TACTILE COUPLING INDICATOR FOR AN ELECTRICAL CONNECTOR

FIELD OF THE INVENTION

The present invention relates to electrical connectors, and specifically to an indicator which audibly and tactilely informs the operator that the connector has been mated and subsequently provides a lasting tactile indication that the connector remains coupled in the mated position.

BACKGROUND AND SUMMARY OF THE INVENTION

With electrical connectors, is is often desirable to have an audible as well as tactile indication that the connector is fully coupled in the mated position. This is desirable for a number of reasons, for example, the fact that the connector can and often does include a large number of corresponding socket and plug connections, for example, in the 10's or sometimes even 100's. In order to fit this number of socket and plug connections into a single connector, the socket and plug connections are often small and, therefore, very fragile electrical contacts. Excessive coupling and decoupling of the connector could damage these contacts, and it may be undesirable to break the circuit for a number of reasons. It has been known in the art to provide some spring loaded means, for example, detent ball and spring which snaps into a socket receptacle for the detent ball when the connector is in the fully coupled mated position. This gives the operator both the tactile and audible indication that coupling has occurred in that the snapping of the ball into the dentent ball socket receptacle can be felt and heard. However, such indicators do not give any subsequent indication as to whether or not the coupling is fully mated without cycling the connector again through the mating sequence of the connector. That is to say, if the connector is of the variety in which the coupling ring is rotated to effect mating of the connector to test whether the connector is in the mated position, the coupling ring would have to be rotated in the unmating direction and then back to the mating direction until tactile and audible indication is given that the connector is mated.

In order to alleviate this problem, it has been known in the art to place some visual marking on the connector parts which indicate the position of the parts relative to each other when the connector is mated. However, it is often the case that the connector or many of the connectors cannot easily be observed visually in order to check the mating or unmating because of the accessibility or poorly lighted condition of the connector. Moreover, even when the connectors are located in an area that has limited access, the orientation of the connectors may be such that the visual markings are totally inaccessible.

It can, therefore, be seen that prior tactile and audible mating indicators for electrical connectors are not entirely satisfactory, Recognizing the drawbacks noted above, it is a general object of the present invention to provide a tactile and audible mating position indicator for an electrical connector which gives both tactile and audible mating indication at the time mating occurs and which is constructed to easily be monitored tactilely or visually to observe whether the connector is in the mated position.

A feature of the present invention resides in an expandable ring which is expanded in response to the operation required to mate the connector and which remains so expanded, thereby extending out from the external surface of one of the connector elements so that touching the connector element, will reveal at a subsequent point in time that the connector is mated.

Another feature of the present invention resides in providing a means for expanding this expandable element which, in doing so, gives tactile and audible indication that the connector is mated at the time the mating operation is performed.

Still another feature of the present invention resides in its ease of construction and operation, particularly with the type of connector which employs a coupling ring to mate the connector by rotation of the coupling ring. An expandable ring is provided in an annular groove in the coupling ring and in the unmated position of the connector remains below the outer surface of the coupling ring. Means are provided to expand the expandable ring responsive to the coupling ring being rotated to a position at which the connector is mated such that the expandable ring extends out above the surface of the coupling ring and can be tactilely felt as indicator that the connector is mated. On unmating, the spring characteristics of the expandable ring causes it to move back into the groove moving the balls back into place.

The above features and advantages of the present invention have been described generally in order that the detailed description of the present invention below may be better understood and the contribution to the art may be better appreciated. These and other features of the present invention will be apparant from the reading of the detailed description of the preferred embodiment described in association with the appended drawings in which like reference numerals have been used to describe like elements.

DETAILED DESCRIPTION OF A PREFERRED EMBODIMENT

Figure 1:
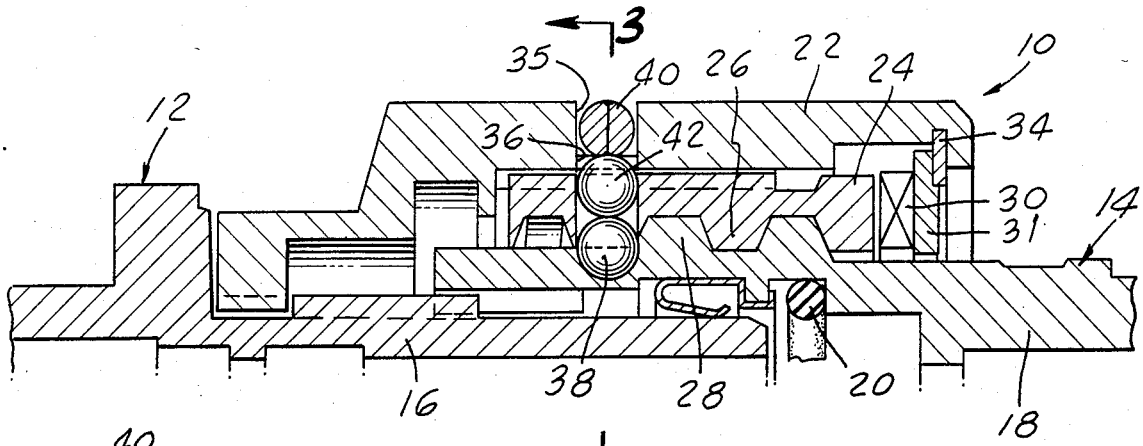
FIG. 1 shows a cut-away partial cross section of a connector employing audible and tactile mating indicator according to the present invention.

Turning now to FIG. 1, there is shown an electrical connector, generally designated as 10, which has been chosen to illustrate the operation of the mating position indicator according to the present invention. The electrical connector which has been selected to illustrate the operation of the present invention is a series IV connector manufactured by the assignee of the present invention, an example of which is disclosed in the copending application to Baur Ser. No. 577,974, now U.S. Pat. No. 4,531,801, which is also assigned to the assignee of the present invention, the disclosure of which is hereby incorporated by reference.

The connector 10 has a plug portion 14 and a receptacle portion 12. Each of the plug portion 14 and receptacle portion 12 contain a plurality of socket electrical contacts and plug electrical contacts, respectively, which are not shown in the present application. It will be understood that the plug portion 14 and receptacle portion 12 are so designated by convention here as in the above-referenced copending application by the physical construction of the plug portion which fits within the receptacle portion 12, regardless of whether the plug portion 14 contains socket electrodes or plug electrodes which provide the actual electrical connector contacts.

The receptacle portion 12 has a generally cylindrical hollow sleeve portion 16 into which a plug insert (not shown) attached to a plug sleeve 18 of the plug portion 14, is inserted when the connector 10 is to be mated. An O-ring 20 of an elastomeric material seals the receptacle portion 12 and plug portion 14 after mating source.

Figure 2:
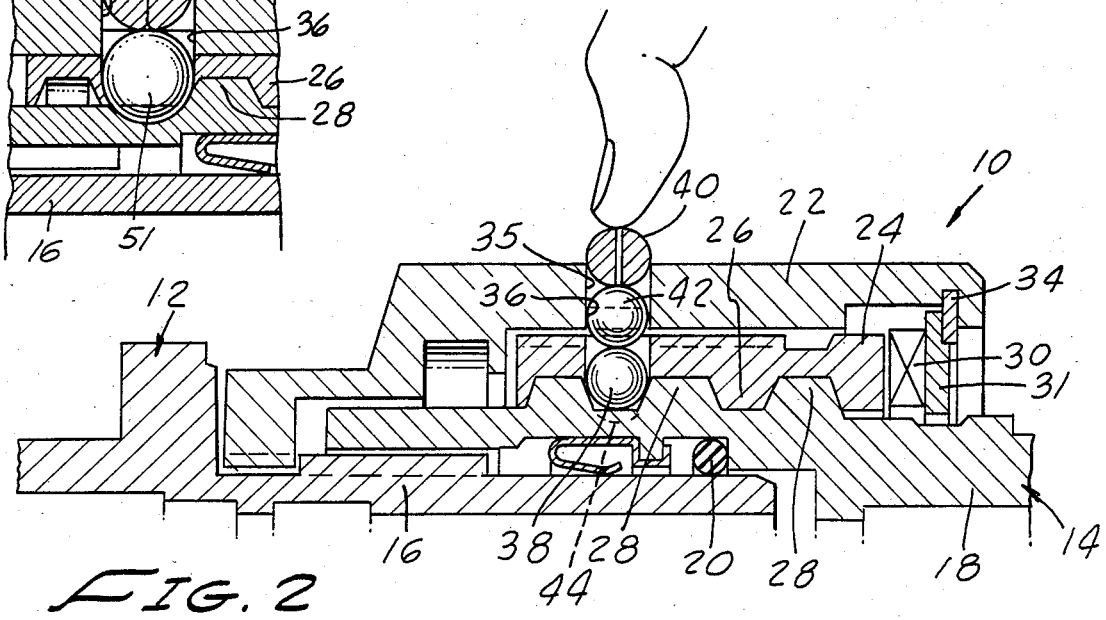
FIG. 2 shows the connector of FIG. 1 in the mated position with the tactile mating indicator expanded to a position where it can be it felt tactilely as an indication that the connector is mated.

Mating is effected in the connector 10 of the kind illustrated in FIGS. 1 and 2 by the rotation of a coupling ring 22 which is a generally cylindrical member surrounding the sleeve 18 and the plug portion 14. The coupling ring 22 has a drive nut 24 which is fixed to the coupling ring 22, for rotation with the coupling ring 22, by keys and a wave spring 30, held in compression by a wave spring cover 31, which in turn is held in place with respect to the coupling ring 22 by a locking ring 34. The drive nut 22 has a plurality of threads 26 which threadably engage of a plurality of threads 28 on the exterior surface of the sleeve 18.

The connector 10 illustrated in FIGS. 1 and 2 has a thread pitch such that rotation of the coupling ring 22 through less than one full turn, for example, through ninety degrees, causes the sleeve 18 to move from the position shown in FIG. 1 to the fully mated position of the connector 10 shown in FIG. 2 in which the connector is coupled with the plug and socket electrical connections (not shown) fully mated.

Figure 3:
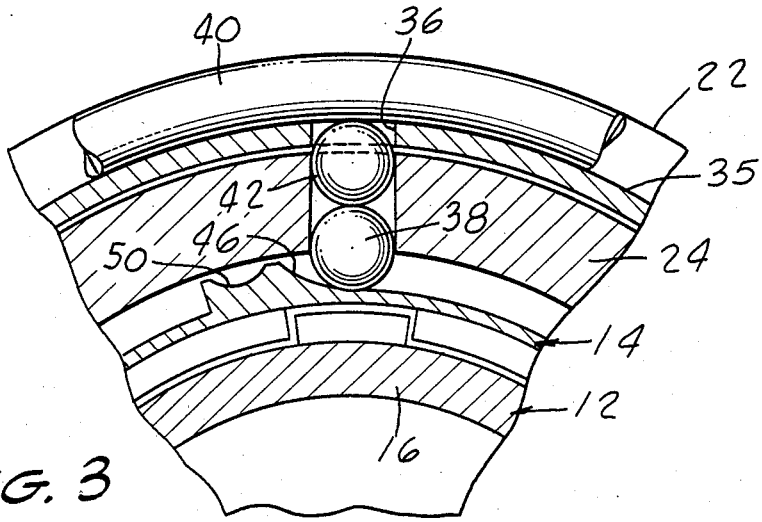
FIG. 3 shows a cross sectional view along lines 3—3 in FIG. 1.

An exterior annular groove 35 is formed in the coupling ring 22, as is shown in more detail in FIG. 3. A plurality of radial openings 36, one of which is shown in FIGS. 1, 2 and 3, are positioned at intervals around the coupling ring, for example 3 spaced 120° apart around the coupling ring. The radial openings 36 open into the exterior annual groove 35 and are aligned with the corresponding plurality of radial openings extending through the drive nut 24. An expandable ring 40 is positioned in the exterior annular groove 35, and as shown in FIG. 1, in the unmated position of the connector 10, is flush with or below the exterior surface of the coupling ring 22.

The expandable ring 40 may be conveniently constructed of a single helical piece of metal formed in the manner of a key ring with approximately two turns of the helix. Positioned below the expandable ring 40 and located in each of the plurality of radial openings 36 is a ball 38 abutting the sleeve 18 and a mechanical coupling ball 42 intermediate the ball 38 and the expandable ring 40.

FIG. 2 illustrates the effect of rotating the coupling ring to the fully mated coupled position of the connector 10 which moves the ball 38 and in turn the mechanical coupling ball 42 radially outward in the respective one of the radial openings 36 causing the expandable ring 40 to expand to a position in which it extends above the exterior surface of the coupling ring 22 around the entire exterior annular groove 35 and can therefore be felt by, for example, running a finger along the exterior surface of the coupling ring 22 as illustrated in FIG. 2.

FIG. 3 shows in further detail the manner in which the balls 38 and 42 are moved radially outwardly in response to rotation of the coupling ring 22. The coupling ring 22 and the drive nut 24 are fixed together such that the drive nut 24 rotates with the coupling ring 22. The ball 38 is of a size, as shown in FIGS. 1 and 2, to fit within the groove between adjacent threads on the sleeve 18. The groove 44 between the adjacent threads on the sleeve 18 in which the ball 38 travels as the coupling ring 22 is rotated through, for example, 90° is formed with a ramp 46. The ramp 46 terminates in a mating position indicator plateau 48 which has formed therein a detent receptor 50 shaped to conform generally to the spherical surface of the ball 38. As can be seen from FIG. 3, when the coupling ring is rotated in a counter clockwise direction, the ball 38 rides up the ramp 46, moving the ball 38 and, therefore, also the ball 42 radially outwardly in the radial opening 36. As the ball 38 reaches the mating position indicator plateau 48, the expandable ring 40 acts as a detent spring through the ball 42 to snap the ball 38 into the detent receptor 50. This provides an audible and tactile indication that the coupling ring 22 has been rotated to the fully mated position of the connector 10. In addition, the expandable ring 40 is retained in an expanded position, jutting out from the surface of the coupling ring 22 around the entire circumference of the coupling ring 22 conforming to the position of the annular groove 35.

Figure 4:
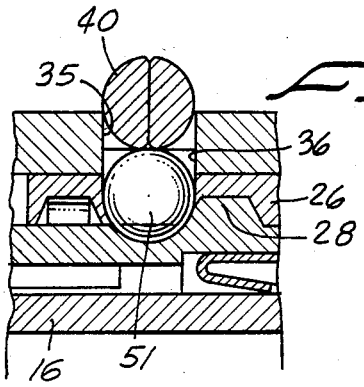
FIG. 4 is a sectional, partially fragmentary view of an alternative embodiment.

With reference now to FIG. 4, there is shown an alternative embodiment of the invention in which a single ball 51 is used in place of the two balls 38 and 42 of the first described version. A single ball is especially advantageous where the coupling ring and drive nut have relatively thin housing walls. Operation and function is identical to that described for the first embodiment.

SUMMARY OF THE SCOPE AND ADVANTAGES OF THE PRESENT INVENTION

It can be seen that the present invention provides significant advantages over prior mating indicators. For example, the mating indicator of the present invention provides both a tactile and audible mating indication upon the occurrence of the mating of the connector and a lasting tactile mating indication which can be observed tactilely without the need to recycle the connector through an unmating and mating operation. This is not only desirable in the instance where the connector may be in a relatively inaccessible location, making observation of visible markings on the connector difficult or impossible, but is also of advantage in dealing with fragile connectors which may be damaged by repeated cycling of the connectors during, for example, maintenance checks or trouble-shooting in which the operator is attempting to determine the mated or unmated state of any given connector. It is also essential in cases where it is highly undesirable to break a circuit to interconnected equipment.

It will be understood by those skilled in the art that any changes and modifications may be made to the present invention without departing from the scope of the present invention. For example, the present invention may be useful in a connector which is not mated through the rotation of a coupling ring. Also, the present invention could be used by providing a ramp generally aligned with the axial direction of a connector of the kind which is mated simply by applying force to the two parts of the connector along the axial direction. In such an embodiment a plurality of grooves containing ramps would be positioned about the circumference of one portion of the connector and an expandable ring contained within an annular groove in the other portion of the connector, with the mating of the connector effecting movement of a ball along each of the ramps, displacing the balls radially outwardly to displace the expandable ring, radially, outwardly. In addition, certain connectors, due either to the absence of a drive nut or to the overall thickness of the coupling ring and drive nut, if there is a drive nut, and also depending upon the size of the threads allowing for clearance of a larger ball, may dispense with the intermediate mechanical coupling ball. Further, the intermediate coupling need not necessarily be a ball, but may be, for example, a generally cylindrical element which mechanically couples the ball riding in the groove containing the ramp to the expandable ring in each of the radial openings.

The number of radial openings may be varied consistent with the insuring that the expandable ring expands outwardly sufficiently to be felt about the entire surface of the portion of the connector where tactile indication that the connector is coupled is desired to be felt and, further, in the case of a connector coupled through the rotation, for example, of a coupling ring, consistent with the amount of rotation required to couple the connector. That is, consistent with the need to employ a plurality of ramps, one for each ball, aligned with each radial opening. Thus, for example, if the coupling ring requires a 90° rotation, 4 ramps and radial openings spaced 90° around the circumference of the coupling ring could be employed. However, as discussed above, in such a circumstance, 3 ramps and radial openings, spaced at 120° may also be used. In addition, ramps may be provided in a groove in a sleeve interior to the coupling ring but not necessarily positioned between adjacent threads which effect the mating of the connector when the coupling ring is connected. The present embodiment disclosed above utilizes an existing groove between adjacent threads on the sleeve in order to make the overall size of the connector in the axial direction as short as possible. Furthermore, the expandable ring may be constructed of a material other than metal, for example, an elastic material having sufficient elasticity to expand in response to the radial outward motion of the means for expanding the expandable ring and with sufficient rigidity to expand circumferentially to insure that the expandable ring extends above the exterior surface of the connector about the entire circumference of the exterior surface.

These and other modifications of the present invention will be understood by those skilled in the art to come within the scope of the appended claims. The appended claims are intended to cover all such variations and modifications of the preferred embodiment disclosed herein as come within the scope and intent of the appended claims.

What is claimed is:

1. A mating indicator for an electrical connector having a generally cylindrical locking ring and a generally cylindrical connector sleeve contained within the interior opening of the generally cylindrical locking ring, and in which rotation of the locking ring moves the sleeve in the axial direction of the connector to effect mating of the connector comprising:

an exterior annular groove in the locking ring;

an expandable ring in the exterior annular groove in the locking ring;

a radial opening in the locking ring opening into the exterior annular groove in the locking ring;

an exterior arcuate groove in the exterior surface of the sleeve;

a ball positioned in the exterior arcuate groove and movable in the exterior arcuate groove in response to rotation of the locking ring to the same degree of rotation along the exterior arcuate groove as the locking ring rotates with respect to the sleeve;

a groove ramp in the exterior arcuate groove inclined to move the ball radially outwardly, and terminating in a mated-position-indicator plateau, said expandable ring having parts moved by the ball outwardly of the coupling ring on said ball being located on the plateau thereby indicating connector mating, and said expandable ring parts being located below the outer surface of the coupling ring indicating connector unmating when the ball is positioned other than on said plateau;

a drive nut intermediate the locking ring and the sleeve connected for rotation with the locking ring and threadably engaging the sleeve; and a radial opening in the drive nut aligned with the radial opening in the locking ring.

2. The apparatus of claim 1 further comprising:

a mechanical coupling between the ball and the expandable ring.

3. The apparatus of claim 2 wherein the mechanical coupling comprises a second ball.

4. The apparatus of claim 1, further comprising:

a mechanical coupling between the ball and the expandable ring, positioned within the radial opening in the drive nut.

5. The apparatus of claim 4, wherein the mechanical coupling comprises a second ball.

6. A mating indicator for an electrical connector having a generally cylindrical locking ring and a generally cylindrical connector sleeve contained within the interior of the generally cylindrical locking ring, and in which rotation of the locking ring moves the sleeve in the axial direction of the connector to effect mating of the connector, comprising:

an exterior annular groove in the locking ring;

an expandable ring in the exterior annular groove in the locking ring;

a plurality of radial openings opening into the exterior annular groove in the locking ring;

a plurality of arcuate grooves in the exterior surface of the sleeve, corresponding in number to the number of radial openings;

a plurality of balls each positioned in a respective one of the arcuate grooves and movable in the respective exterior arcuate groove in response to rotation of the locking ring to the same degree of rotation in the exterior arcuate groove as the locking ring rotates with respect to the sleeve;

a groove ramp in each of the plurality of exterior arcuate grooves inclined to move the balls radially outward and terminating at a mated-position-indicator plateau, the expandable ring having parts moved by the balls outwardly of the coupling ring on said balls being located on the plateau thereby indicating connector mating, and said expandable ring parts being located below the outer surface of the coupling indicating connector unmating when the balls are positioned other than on said plateau;

a drive nut connected for rotation with the locking ring and threadably engaging the sleeve; and a plurality of radial openings in the drive nut, each aligned with a respective radial opening in the locking ring.

7. The apparatus of claim 6 further comprising:

a mechanical coupling between each of the plurality of balls and the expandable ring.

8. The apparatus of claim 7 wherein the mechanical coupling comprises a second ball intermediate each of the plurality of balls and the expandable ring.

9. The apparatus of claim 6 further comprising:

a mechanical coupling between each of the balls and the expandable ring, positioned within a respective one of the plurality of radial openings in the drive nut.

10. The apparatus of claim 9 wherein the mechanical coupling comprises a second ball, intermediate each of the plurality of balls and the expandable ring.

* * * * *